US006213359B1

(12) United States Patent
Gish

(10) Patent No.: US 6,213,359 B1
(45) Date of Patent: Apr. 10, 2001

(54) NON-SLIP TROUSERS HANGER

(76) Inventor: Donald A. Gish, 807 Lynn Ave., Antioch, CA (US) 94509

( * ) Notice: Subject to any disclaimer, the term of this patent is extended or adjusted under 35 U.S.C. 154(b) by 0 days.

(21) Appl. No.: 09/507,909

(22) Filed: Feb. 22, 2000

(51) Int. Cl.[7] ..... A47G 25/14
(52) U.S. Cl. ..... 223/98; 223/85
(58) Field of Search ..... 223/85, 98, 92, 223/95

(56) References Cited

U.S. PATENT DOCUMENTS 2,774,527 * 12/1956 Iverson ..... 223/98
2,859,903 * 11/1958 Tufts ..... 223/98
3,179,315 * 4/1965 Sierdzki ..... 223/98
6,012,620 * 1/2000 Murray ..... 223/98
6,126,049 * 10/2000 Gish ..... 223/96

* cited by examiner

*Primary Examiner*—Bibhu Mohanty
(74) *Attorney, Agent, or Firm*—Linval B. Castle

(57) ABSTRACT

A non-slip trousers hanger is formed from a conventional plastic clothes hanger by cementing a layer of polyurethane around the entire surface of the horizontal bar. This is easily and quickly done by slitting a polyurethane tubing having an I.D. equal to the diameter of the bar and slipping the tubing over an adhesive coated bar.

1 Claim, 1 Drawing Sheet

NON-SLIP TROUSERS HANGER

CROSS REFERENCE TO RELATED APPLICATIONS

This application is related to my application Ser. No. 09/369,258, filed Aug. 9, 1999 for Non-Slip Clothes Hangers now U.S. Pat. No. 6,126,049.

BACKGROUND OF THE INVENTION

This invention relates to clothes hangers and in particular to a non-slip hanger for securing slacks and trousers.

The long length of trousers suggests that they should be suspended from the cuff in order to retain their crease. But they are rarely hung in this manner and the preferred storage method is to fold the trousers and hang them across the horizontal bar of a conventional clothes hanger. Because of difficulties in balancing the trousers on a smooth and slippery clothes hanger bar, some people and retail establishments employ special hangers with double horizontal bars, one conventional for suspending the trousers and the second resilient bar, closely adjacent the first, for clamping the trousers. These hangers work very well in clamping slacks or trousers but the hard thin horizontal rod suspending the trousers causes an undesirable crease in the fabric.

This invention is for a conventional clothes hanger with a soft plastic foam tubing, such as polyurethane foam tubing, a common inexpensive material that has a non-adhesive cellular structure that will grip the fabric. The tubing is split and cemented around the horizontal bar giving it a relatively large diameter so that the fabric of the trousers cannot slide and it will not cause undesirable creases across the trousers.

BRIEF DESCRIPTION OF THE DRAWINGS

In the drawings that illustrate a preferred embodiment of the invention.

DETAILED DESCRIPTION OF THE PREFERRED EMBODIMENT

Figure 1:
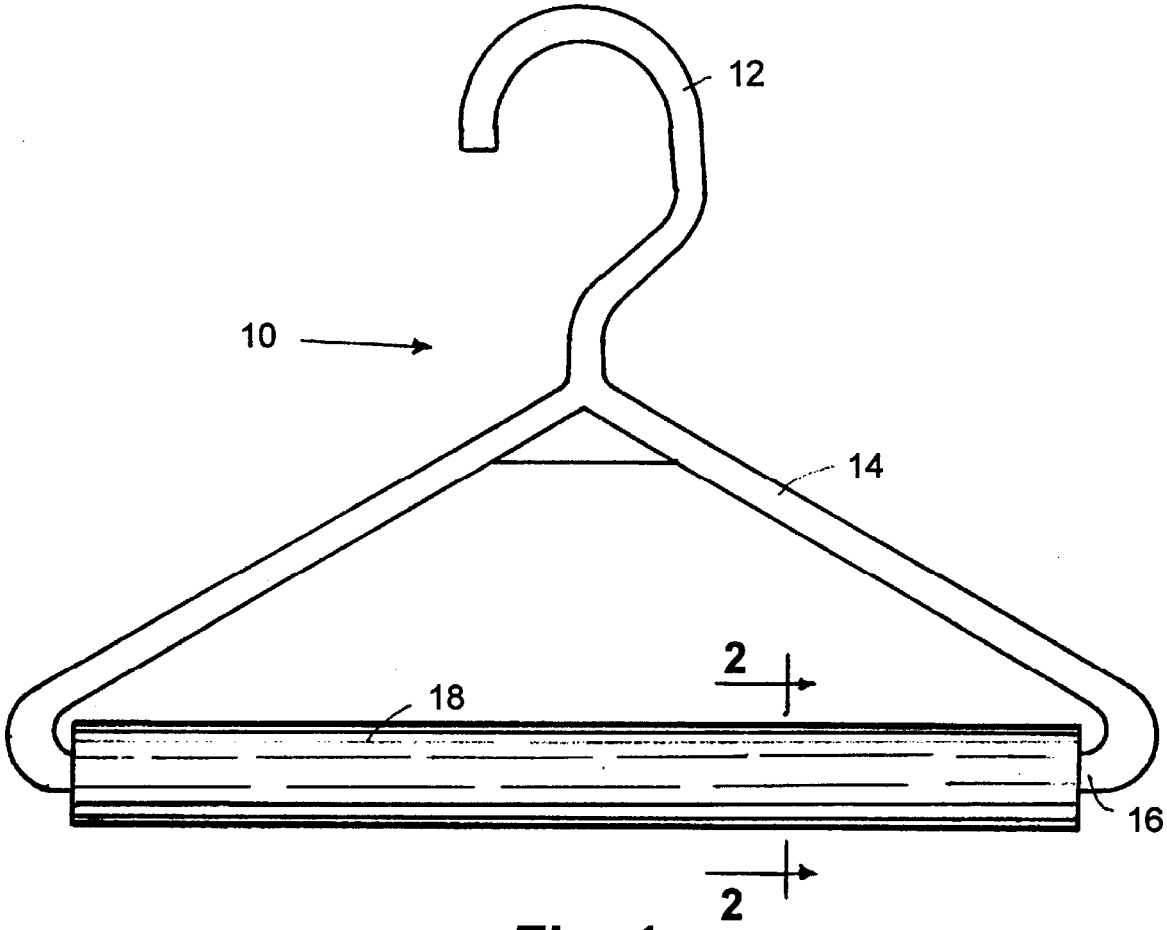
FIG. 1 is an elevational view illustrating a clothes hanger with a plastic sponge horizontal bar.

Illustrated in FIG. 1 is a conventional inexpensive plastic clothes hanger 10 having a semicircular hanging hook 12 at the top with side bars 14 angularly branching out and joining the ends of a horizontal bar 16 which is intended for the suspension of slacks and trousers. Usually the entire plastic clothes hanger is cast in ¼ inch round plastic rod which results in both a slippery support which the trousers easily slide from and also a fairly sharp crease across the fabric of the trousers.

Figure 2:
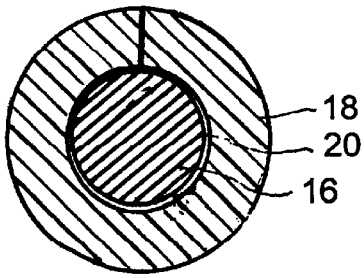
FIG. 2 is an enlarged sectional view taken along the lines 2—2 of FIG. 1.

This difficulty is easily and very inexpensively overcome with the present invention illustrated in FIG. 1 and in the sectional cross section illustration of the horizontal cross bar 16 in FIG. 2.

The horizontal bar 16 of the clothes hanger 10 is covered with plastic foam, such as polyurethane foam. While a flat ribbon of foam material of minimum thickness of ⅛ inch may be cemented around and horizontal bar, the quickest and simplest method of covering a circular rod, such as the horizontal bar 16, is by slitting an appropriate length of tubing 18, such as polyurethane tubing, having an inside diameter equal to the diameter of the horizontal bar 16 and slipping the tubing over the bar which has been coated with a suitable adhesive 20. The outside diameter of the polyurethane tubing 18 may be any desired diameter from ½ inch up. Slacks and trousers may be suspended on the tubing without forming a crease across the leg fabric and without danger of slipping from the hanger.

I claim:

1. The method of forming a non-slip trousers hanger from a plastic clothes hanger having a top hook coupled to angularly branching side bars that terminate at the ends of a circular horizontal bar, said method comprising the steps of:

obtaining a length of polyurethane foam tubing having an interior surface and an exterior surface, said tubing having a length substantially equal to the length of said horizontal bar and an inside diameter substantially equal to the diameter of said horizontal bar;

slitting said length of foam tubing from said exterior surface to said interior surface; and slipping said horizontal bar into the slit in said foam tubing and cementing the tubing to said bar to prevent rotation of said tubing.

* * * * *